United States Patent [19]

Jünger et al.

[11] 4,256,623

[45] Mar. 17, 1981

[54] BINDING AGENTS PREPARED FROM RESINS CONTAINING ADHESIVIZING AGENTS OF LONG SHELF LIFE

[75] Inventors: Hans Jünger, Troisdorf; Claus-Dieter Seiler, Rheinfelden, both of Fed. Rep. of Germany

[73] Assignee: Dynamit Nobel Aktiengesellschaft, Troisdorf, Fed. Rep. of Germany

[21] Appl. No.: 54,520

[22] Filed: Jul. 3, 1979

[30] Foreign Application Priority Data

Jul. 6, 1978 [DE] Fed. Rep. of Germany ..... 2829669

[51] Int. Cl.[3] ..... B22C 1/20; B22C 1/22; C08L 61/10

[52] U.S. Cl. ..... 260/38; 164/43; 260/29.1 SB

[58] Field of Search ..... 260/38, DIG. 40, 29.1 SB; 164/43

[56] References Cited

U.S. PATENT DOCUMENTS

| | | | |
|---|---|---|---|
| 2,832,754 | 4/1958 | Jex et al. | 528/38 |
| 3,234,159 | 2/1966 | Cooper | 260/29.3 |
| 3,403,721 | 10/1968 | Robins et al. | 164/43 |
| 3,646,999 | 3/1972 | Hamby et al. | 260/DIG. 40 |
| 3,745,139 | 7/1973 | Kachur et al. | 260/38 |
| 3,847,860 | 11/1974 | Seiler et al. | 260/38 |
| 4,083,817 | 4/1978 | Anderson | 164/43 |
| 4,111,253 | 9/1978 | Epstein et al. | 164/43 |

FOREIGN PATENT DOCUMENTS

| | | |
|---|---|---|
| 1008462 | 10/1965 | United Kingdom . |
| 1143351 | 2/1969 | United Kingdom . |

*Primary Examiner*—Ronald W. Griffin

*Attorney, Agent, or Firm*—Sprung, Felfe, Horn, Lynch & Kramer

[57] ABSTRACT

A binding agent comprising a hardenable resin and aminosilane is described wherein the aminosilane is alkylated on the nitrogen and/or on the silicon atom.

20 Claims, No Drawings

BINDING AGENTS PREPARED FROM RESINS CONTAINING ADHESIVIZING AGENTS OF LONG SHELF LIFE

BACKGROUND OF THE INVENTION

1. Field of the Invention

This invention relates to a composition comprising a synthetic resin and a silane having especially good shelf life which can be employed for the production of foundry molds. More particular, this invention relates to a composition comprising the thermosetting resin and a silane alkylated on the nitrogen and/or the silicon atom, the aminoalkylsilane being employed as an improved adhesivizing agent for an inorganic oxidic material.

2. Discussion of the Prior Art

It is known that aminoalkyl trialkoxysilanes, such as γ-aminopropyltrimethoxysilane, improves the adherence of thermosetting resins to inorganic oxide material. It is furthermore known that these aminosilanes can be mixed with thermosetting phenolic resins and then these resins can be mixed directly with sands or other inorganic oxide material to be shaped and solidified (cf. DE-AS No. 1,252,853 and DE-PS No. 1,494,381).

The use of N-(aminoalkyl)-aminoalkylsilanes as adhesion improvers between thermosetting resins and inorganic oxide material is also known. These compounds are used in the same manner as the aminosilanes in which there is no substitution on the nitrogen atom (cf. U.S. Pat. No. 3,234,159).

Both the aminoalkylsilanes which are not substituted on the nitrogen atom and those which are substituted by amino groups, which are referred to hereinafter as aminosilanes, improve the adhesion of thermosetting phenolic resins to inorganic oxide substances to virtually the same degree when they are mixed with the resins. This improvement of adhesion, however, diminishes in the course of time if these aminosilane-containing resins are stored for a relatively long time at room temperature. After standing for only 14 days, the adhesion-improving action of aminosilanes declines by about 40%, and at the end of only a month the adhesivizing effect produced by γ-aminopropyltriethoxysilane in phenolic resin has been reduced by one half.

The loss of the adhesivizing action of the aminosilanes in the mixture with thermosetting resins is probably due to a decomposition of these silanes in the resins. The problem therefore existed of finding an adhesivizing agent which, when mixed with thermosets, decomposes very slightly or not at all, and produces their adhesivizing action to the same or an only slightly lesser extent, even after the resin has been stored for a relatively long time, and which therefore will serve for the preparation of binding agents for inorganic oxide materials such as, for example, foundry sands, such binding agents being made from aminosilanated phenolic resins whose effectiveness will remain unaltered or only slightly reduced, even after a relatively long period of storage.

SUMMARY OF THE INVENTION

The foregoing solutions with respect to shelf life are solved in accordance with the invention wherein as an aminosilane there is employed one which is alkylated, e.g., additionally alkylated on the nitrogen and/or on the silicon atom. Thus, the composition of the present invention comprises a hardenable synthetic resin, e.g., a cold-setting resin and an aminosilane wherein the aminosilane is one alkylated on the nitrogen and/or on the silicon atom. The binding agent of the present invention is suitable for the binding of inorganic oxidic material especially sand where it exhibits improved shelf life as compared with unalkylated known aminosilanes as will appear from the data below.

Surprisingly, cold-setting resins, such as phenol-formaldehyde resins for example, which contain the claimed substituted aminosilanes, undergo little or no loss of their ability to adhere to inorganic oxide materials, the absolute adhesivity of these binding agents being equal to or in some cases even greater than that of unsubstituted aminosilanes.

The stability of aminosilanes in cold-sets is greatly improved even when only one hydrogen atom of the amino or imino group of the aminosilanes is replaced by an alkyl group. It is even sufficient for one additional alkyl group to be on the silicon atom.

Stability is further improved if one of the hydrogen atoms of the amino group is replaced by an alkyl group and an additional alkyl group is either on the silicon atom or on the second nitrogen atom. In such di-substituted aminosilanes there is virtually no loss of the adhesivizing action of these silanes over a relatively long period of time when they are in mixtures with cold-sets.

The silanes are derived either from ω-aminoalkyltrialkoxysilanes of the formula $H_2N\text{-}(CH_2)_n\text{-}Si(OR)_3$, in which n=2 to 4 and R is a $C_1$ to $C_4$ alkyl moiety, or from N-(aminoalkyl)aminoalkylsilanes of the formula $$H_2N\text{-}(CH_2)_m\text{-}NH\text{-}(CH_2)_nSi(OR)_3 \ (m=2 \text{ or } 3),$$

the latter also being referred to as diaminosilanes.

In these formulas, at least one of the hydrogen atoms on one or both nitrogen atoms or one of the alkoxy groups is replaced by an alkyl group. The alkyl groups involved are mainly the methyl, ethyl or butyl groups. The alkyl group can contain up to 8 carbon atoms and can contain as substituents: only alkyl groups.

Examples of usable aminosilanes are accordingly: N-methyl-γ-aminopropyltriethoxysilane, N-ethyl-γ-aminopropyltrimethoxysilane, N-methyl-β-aminoethyltrimethoxysilane, γ-aminopropylmethyldimethoxysilane, N-methyl-γ-aminopropylmethyldimethoxysilane, N-(β-N-methylaminoethyl)-γ-aminopropyltriethoxysilane, N-(γ-aminopropyl)-γ-aminopropylmethyldimethoxysilane, N-(γ-aminopropyl)-N-methyl-γ-aminopropylmethyldimethoxysilane and γ-aminopropylethyldiethoxysilane.

The silanes to be used are in themselves known compounds. They can be prepared in several known ways, such as those described in German Pat. Nos. 1,023,462 or 1,128,773 or German Auslegeschrift No. 1,152,695.

The hardenable resins whose adhesion to inorganic oxide materials is improved by the substituted aminosilanes are also known compounds in themselves. The term "hardenable resins," as used herein, is to be understood to refer mainly to phenol-formaldehyde resins and resins on the basis of furfuryl alcohol and copolycondenstates of furfuryl alcohol phenol urea and formaldehyde which are also referred to as furan resins. The phenol-formaldehyde resins are generally obtained by the alkaline condensation of phenols and formaldehyde in a ratio of $1:\geqq 1$, followed by distillation of the water contained in the condensation mixture until the desired solid resin content is achieved. They can also be modified with urea and/or furfuryl alcohol. The pH of the resins is generally greater than 7. They are generally in liquid form, but they can also be used dissolved in appropriate solvents.

The mixing of the silanes with the resin is also performed in a known manner. The amount of silanes contained in the resin is of the same order of magnitude as the aminosilane content in the known phenolic resin binding agents. Amounts of as little as 0.1% of the weight of the resin suffice to produce a marked effect. In general, the resin contains between 0.2 and 2% of the silanes by weight. However, one can admix up to 5%, by weight, of silanes.

The extended shelf life is produced both in cold-setting and in hot-setting phenolic resins if they contain the alkyl-substituted aminosilanes. The improvement is especially evident in the case of cold-setting phenolic resins.

The new binding agents are suitable mainly for the production of molding compositions containing sand as the inorganic oxide filler. Such molding compositions are used, for example, in the foundry industry. However, molding compositions can also be prepared with other inorganic oxide materials, such as, for example, glass in its various forms (fibers, threads, spheres), quartz, silicates, aluminum oxide, or titanium oxide.

The testing of the adhesivizing action and of the shelf life of the new binding agent is best performed by measuring the flexural strength of test specimens made from sand which have been solidified by means of the new binding agents. After mixing the sand with the binding agent and hardener, the test specimens are allowed to cure and are tested for flexural strength with the +GF+ bending test apparatus after different curing periods. Since the curing and the strength depend on many different factors, the flexural strength of three samples was determined after 1, 2, 4, 6 and 24 hours of curing in all of the examples that follow. The average of the individual determinations were again averaged with the measurements obtained after all the other curing times. In the averages obtained in this manner the influence of external conditions on the curing is largely compensated. They are easily compared with the averages obtained in the same manner from samples which were made with the same binding agent stored for a shorter or longer time.

In order to more fully illustrate the nature of the invention and the manner of practicing the same, the following examples are presented. Comparative examples are shown to demonstrate the improved shelf life provided by the alkylated aminosilanes employed in accordance with the present invention.

EXAMPLES

Examples 1-5

For these examples, a cold-setting commercial phenolic resin was used (commercial name T 775, manufacturer: Dynamit Nobel AG, Troisdorf), which has a molar ratio of phenol to formaldehyde of 1:1.6, and whose alkali content was 0.9% (pH=7.9). The silanes named in the following table were mixed with the resin in amounts of 0.2% of the weight of the whole resin. The mixture was stored in the laboratory at temperatures between 20° and 26° C.

After a storage time of about 12 hours, test specimens of each mixture were prepared as follows: 100 weight-parts of Haltern sand H32 were mixed with 0.48 parts by volume of a 65% aqueous solution of p-toluenesulfonic acid. After the same had been uniformly moistened, 1.2 weight-parts of the resin with respect to the sand were added to the sand and mixed.

To prepare the test specimens, the damp, friable mixture was placed in a +GF+ test bar mold and compressed in a +GF+ ramming apparatus with three strokes of the ram. The specimens were then stripped out of the mold onto a glass plate. There they were allowed to cure.

After one hour of curing, the flexural strengths of three specimens were determined in a +GF+ flexural test apparatus and the average was calculated. The differences between the individual results were slight.

After two hours of curing, the same measurements were performed with another three specimens. In like manner, the flexural strengths were determined after four, six and twenty-four hours. The averages obtained in each case were again determined and entered in the following Table 1 as $M_{A1}$.

Test specimens were made from the resin-silane mixtures after a storage period of 14 and 30 days in the same manner as after the one-day storage period, and their flexural strength was determined after curing. The averages are given in the table as $M_{A14}$ and $M_{A30}$, respectively.

Also listed in Table 1 are the flexural strengths obtained by the use of a resin containing no silane, and of resins containing γ-aminopropyltriehoxysilane. These are given for purposes of comparison (Examples 1 and 2 ).

A measure of shelf life is the loss of strength (in %) of the specimens over the period of time for which the binding agent was stored. Another measure of shelf life is the increase in strength (in %) which is obtained in comparison with a resin which contains no silane. Here the only interest is a comparison of the values after the resins have been stored for 30 days.

TABLE 1

| Example No. | Silane Used | Flexural Strengths (kp/cm²) $M_{A1}$ | $M_{A14}$ | $M_{A30}$ | Loss of Strength (%) between 1 and 14 days | 14 and 30 days | 1 and 30 days | Increase (%) in comparison with Examples Nos. 1 ($M_{A30}$) | 2 ($M_{A30}$) |
|---|---|---|---|---|---|---|---|---|---|
| 1 | none | 5.8 | 6.0 | 5.7 | 0 | 5 | 2 | — | — |
| 2 | $H_2N-(CH_2)_3Si(OC_2H_5)_3$ | 28.0 | 16.5 | 15.5 | 41.0 | 6 | 45.0 | 172 | — |
| 3 | $HN(CH_3)-(CH_2)_3-Si(OCH_3)_3$ | 25.8 | 26.0 | 23.5 | 0 | 9.6 | 9.0 | 312 | 51.6 |
| 4 | $H_2N-(CH_2)_3-Si(CH_3)(OCH_3)_2$ | 29.6 | 30.0 | 27.8 | 0 | 7.3 | 6.0 | 388 | 79.4 |

TABLE 1-continued

| Example No. | Silane Used | Flexural Strengths (kp/cm²) $M_{A1}$ | $M_{A14}$ | $M_{A30}$ | Loss of Strength (%) between 1 and 14 days | 14 and 30 days | 1 and 30 days | Increase (%) in comparison with Examples Nos. 1 ($M_{A30}$) | 2 ($M_{A30}$) |
|---|---|---|---|---|---|---|---|---|---|
| 5 | $HN(CH_3)-(CH_2)_3-Si(CH_3)(OCH_3)_2$ | 29.8 | 30.3 | 31.8 | 0 | 0 | 0 | 458 | 105 |
| 6 | $HN(C_2H_5)-(CH_2)_3-Si(OCH_3)_3$ | 25.5 | 25.9 | 23.4 | 0 | 9.6 | 8.2 | 310 | 51 |

Examples 7–11

In a manner similar to Examples 1 to 6, a cold-setting phenolic resin having a phenol-to-formaldehyde ratio of 1:1.6 and an alkali content of 0.9% (pH=7.9) was mixed with the silanes listed in Table 2 in amounts of 0.2% of the weight of the whole resin. The mixtures were stored at temperatures between 20° and 26° C.

After a storage period of one, 14, and 30 days, samples were made into test specimens as in Examples 1 to 6, and their flexural strength was measured and averaged as described in Examples 1 to 5. The results of the measurements are given in Table 2. Examples 7 and 8 are given for purposes of comparison.

TABLE 2

| Example No. | Silane Used | Flexural Strengths (kp/cm²) $M_{A1}$ | $M_{A14}$ | $M_{A30}$ | Loss of Strength (%) between 1 and 14 | 14 and 30 | 1 and 30 | Increase (%) in comparison with Examples Nos. 7 ($M_{A30}$) | 8 ($M_{A30}$) |
|---|---|---|---|---|---|---|---|---|---|
| 7 | none | 5.8 | 5.5 | 5.3 | 5.2 | 3.6 | 8.6 | — | — |
| 8 | $H_2N(CH_2)_2-NH-(CH_2)_3Si(OCH_3)_3$ | 15.2 | 9.7 | 9.7 | 36.2 | 0 | 36.2 | 83 | — |
| 9 | $H_2N(CH_2)_3NH(CH_2)_3-Si(CH_3)(OCH_3)_2$ | 18.7 | 14.6 | 14.1 | 21.9 | 3.4 | 24.6 | 166 | 45 |
| 10 | $H_2N(CH_2)_3N(CH_3)(CH_2)_3-Si(CH_3)(OCH_3)_2$ | 20.4 | 19.0 | 19.1 | 6.9 | (0.5*) | 6.4 | 260 | 97 |
| 11 | $HN(CH_3)(CH_2)_2N(CH_3)-(CH_2)_3Si(OCH_3)_3$ | 8.2 | 11.5 | 12.9 | (40.2*) | (12.2*) | (57.3*) | 143 | 33 |

*Increase

Examples 12–16

0.2 Weight-parts of the silanes named in Table 3 were mixed with a commercial phenolic resin (phenol:formaldehyde ratio 1:1.4) whose alkali content amounted to 1.5% (pH=8.5). After the moisture had been distilled out, another 5 weight-percent of phenol, with respect to the whole resin, was added and mixed. The mixtures obtained were stored in the laboratory for a total of thirty days at temperatures between 20° and 24° C. After a period of one, 14 and 30 days, samples were prepared from the resin in the manner described in Examples 1 to 6, and their flexural strength was determined and averaged as described. The results of the measurements are given in Table 3. Examples 12 and 13 are measurements performed for purposes of comparison.

TABLE 3

| Example No. | Silane Used | Flexural Strengths (kp/cm²) $M_{A1}$ | $M_{A14}$ | $M_{A30}$ | Loss of Strength (%) between 1 and 14 days | 14 and 30 days | 1 and 30 days | Increase (%) in comparison with Examples Nos. 12 ($M_{A30}$) | 13 ($M_{A30}$) |
|---|---|---|---|---|---|---|---|---|---|
| 12 | none | 6.2 | 5.6 | 5.0 | 9.7 | 10.7 | 19.4 | — | — |
| 13 | $H_2N-CH_2-CH_2-CH_2-Si(OCH_3)_3$ | 14.6 | 8.0 | 7.6 | 45.2 | 5.0 | 47.9 | 52 | — |
| 14 | $HN(CH_3)-CH_2-CH_2-CH_2-Si(OCH_3)_3$ | 13.8 | 12.7 | 11.7 | 7.9 | 7.8 | 15.2 | 134 | 54 |
| 15 | $HN(CH_3)-CH_2-CH_2-CH_2-Si(CH_3)(OCH_3)_2$ | 16.2 | 15.1 | 15.0 | 6.2 | 1.3 | 7.4 | 200 | 97 |
| 16 | $H_2N(CH_2)_3N(CH_3)-(CH_2)_3-Si(CH_3)(OCH_3)_2$ | 15.8 | 15.9 | 15.1 | 0 | 5.0 | 4.4 | 202 | 99 |

Example 17

0.2 Weight-parts of N-methyl-γ-aminopropyltrimethoxysilane were mixed into a modified thermosetting phenolic resin which was produced by the method of German Pat. No. 1,815,897 and had a pH of 7.5. The silanated resin was stored at room temperature for 39 days. After storage periods of one, 13 and 39 days, test specimens were prepared from the resin as described below.

100 Weight-parts of Haltern sand H32 were placed in a mixer and a commercial aqueous hardener solution on a basis of $NH_4NO_3$, urea and sulfite waste liquor were added in the amount of 16 parts by volume, with respect to the resin. After the hardener solution had been mixed in, 1.2 weight-parts, with respect to sand, of the above-specified resin were added to the sand and mixed. After a mixing period of about four minutes a uniform mixture was obtained. This resin and sand mixture was shot on a core shooting machine at a temperature of 220° C. and a pressure of 7 bars to form test specimens. After residence times (curing times) of 10, 15, 30 and 60 seconds in the core shooting machine, the specimens were removed from the mold and their flexural strength (hot) was measured directly (hot flexural strength). Furthermore, test specimens representing the different curing times were let stand for three hours in a draft-free place and then their flexural strength (cold) was measured.

The values obtained after the different curing periods were again averaged, and they are given in Table 4 (Specimen A). A resin (Specimen B) containing γ-aminopropyltriethoxysilane as adhesivizer in the same amounts and prepared in the same manner serves for comparison.

TABLE 4

| Resin storage time | Flexural strength (kp/cm²) Hot A | Hot B | Cold A | Cold B |
|---|---|---|---|---|
| 1 | 19.3 | 17.0 | 37.5 | 34.6 |
| 12 | 15.7 | 14.3 | 35.8 | 31.9 |
| 39 | 12.6 | 11.8 | 31.8 | 27.7 |

The experiments show that alkyl-substituted aminosilanes have a better shelf life than unsubstituted aminosilanes also in thermosetting resins. The improvement also is evidenced by the fact that after the resins have been stored for about six weeks they can be used in preparing molded articles whose flexural strength is approximately 15% better than that of molded articles which have been made with the use of a known resin which has been stored for six weeks.

What is claimed is:

1. In a binding agent for an inorganic oxidic material comprising a hardenable resin and an aminosilane the improvement wherein said amino silane contains an unsubstituted alkyl group on the nitrogen and/or on the silicon atom.

2. A binding agent according to claim 1 wherein said aminosilane has the formula $$H_p\underset{\underset{R}{|}}{N}[(CH_2)_n\underset{\underset{R_m}{|}}{Si}(OR_{3-m}]_{2-p}$$

where n=1 to 3, m=0 or 1, p=0,or 1 and each R represents a $C_1$ to $C_4$ alkyl moiety.

3. A binding agent according to claim 1 wherein said aminosilane has the formula $$R\,NH-(CH_2)_p\underset{\underset{R_m}{|}}{N}H_{-m}-(CH_2)_n-\underset{\underset{R_m}{|}}{Si}(OR)_{3-m}$$

wherein n=1 to 3, m=0 or 1, p=2 or 3, and each R represents a $C_1$ to $C_4$ alkyl moiety.

4. A composition comprising an inorganic oxidic material and the binding agent of claim 1.

5. A composition according to claim 4 wherein said inorganic oxidic material is sand.

6. A composition according to claim 4 wherein said hardenable resin is a phenol-formaldehyde resin.

7. A composition according to claim 4 wherein said hardenable resin is a polycondensation product of phenol, furfuryl alcohol, urea, and formaldehyde.

8. A composition according to claim 1 wherein said silane is selected from the group consisting of N-methyl-γ-aminopropyltriethoxysilane, N-ethyl-γ-aminopropyltrimethoxysilane, N-methyl-β-aminoethyltrimethoxysilane, γ-aminopropylmethyldimethoxy silane, N-methyl-γ-aminopropylmethyldimethoxysilane, N-(β-N-methylaminoethyl)-γ-aminopropyltriethoxysilane, N-(γ-aminopropyl)-γ-aminopropylmethyldimethoxysilane, N-(γ-aminopropyl)-N-methyl-γ-aminopropylmethyldimethoxysilane and γ-aminopropylethyldiethoxysilane.

9. A composition according to claim 4 wherein said silane is selected from the group consisting of N-methyl-γ-aminopropyltriethoxysilane, N-ethyl-γ-aminopropyltrimethoxysilane, N-methyl-β-aminoethyltrimethoxysilane, γ-aminopropylmethyldimethoxy silane, N-methyl-γ-aminopropylmethyldimethoxysilane, N-(β-N-methylaminoethyl)-γ-aminopropyltriethoxysilane, N-(γ-aminopropyl)-γ-aminopropylmethyldimethoxysilane, N-(γ-aminopropyl)-N-methyl-γ-aminopropylmethyldimethoxysilane and γ-aminopropylethyldiethoxysilane.

10. A composition according to claim 1 wherein the alkyl group has up to 8 carbon atoms.

11. A composition according to claim 4 wherein said silane is present in an amount up to 5% by weight with respect to the hardenable resin.

12. A composition according to claim 11 wherein said inorganic oxide is quartz, a silicate, aluminum oxide, titanium oxide or a sand.

13. A binding agent according to claim 1, in which the silane is alkylated on the nitrogen atom.

14. A binding agent according to claim 1, in which the silane is alkylated on the silicon atom.

15. A binding agent according to claim 1, in which the silane is alkylated on both the nitrogen and silicon atoms.

16. A binding agent according to claim 1, wherein said hardenable resin is a phenol-formaldehyde resin, a furfuryl alcohol based resin or a copolycondensate of furfuryl-alcohol, phenol, urea and formaldehyde.

17. A binding agent according to claim 1, wherein the nitrogen atom contains an unsubstituted alkyl group.

18. A binding agent according to claim 1, wherein the silicon atom contains an unsubstituted alkyl group.

19. A binding agent according to claim 17, wherein said unsubstituted alkyl group is methyl, ethyl or butyl.

20. A binding agent according to claim 18, wherein said unsubstituted alkyl group is methyl, ethyl or butyl.

* * * * *

UNITED STATES PATENT AND TRADEMARK OFFICE

CERTIFICATE OF CORRECTION

PATENT NO. : 4,256,623

DATED : Mar. 17, 1981

INVENTOR(S) : Hans Jünger et al

It is certified that error appears in the above—identified patent and that said Letters Patent is hereby corrected as shown below:

Column 8, Line 3, Delete "$H_{-m}$" and insert --$H_{1-m}$--.

Column 8, Line 41, Delete "4" and insert --1--.

Signed and Sealed this

*Twenty-eighth* Day of *July 1981*

[SEAL]

*Attest:*

GERALD J. MOSSINGHOFF

*Attesting Officer*

*Commissioner of Patents and Trademarks*